US009631423B2

(12) United States Patent
Hornung

(10) Patent No.: US 9,631,423 B2
(45) Date of Patent: Apr. 25, 2017

(54) WINDOW SCREENS, SCREEN COMPONENTS, STORM PANELS, AND MARKETING PRODUCTS

(71) Applicant: Robert E. Hornung, Westport, CT (US)

(72) Inventor: Robert E. Hornung, Westport, CT (US)

(73) Assignee: Industrial Sales Corporation, Westport, CT (US)

( * ) Notice: Subject to any disclaimer, the term of this patent is extended or adjusted under 35 U.S.C. 154(b) by 0 days.

(21) Appl. No.: 14/725,255

(22) Filed: May 29, 2015

(65) Prior Publication Data

US 2015/0345209 A1 Dec. 3, 2015

Related U.S. Application Data

(60) Provisional application No. 62/005,286, filed on May 30, 2014.

(51) Int. Cl.
*E06B 9/52* (2006.01)
*E05D 15/06* (2006.01)
*E06B 3/42* (2006.01)

(52) U.S. Cl.
CPC ..... *E06B 9/52* (2013.01); *E05D 15/0621* (2013.01); *E05D 15/0665* (2013.01); *E06B 3/42* (2013.01); *E05Y 2600/53* (2013.01); *E05Y 2900/10* (2013.01); *E05Y 2900/136* (2013.01); *E06B 2009/527* (2013.01)

(58) Field of Classification Search
CPC ... E06B 9/52; E06B 9/521; E06B 9/42; E05D 15/0665; E05D 15/0621; E05D 2009/527; E05Y 2900/136
See application file for complete search history.

(56) References Cited

U.S. PATENT DOCUMENTS 1,765,388 A * 6/1930 Watson ..... E06B 9/52 160/369
1,785,584 A * 12/1930 Higgin ..... E06B 9/52 160/40

(Continued)

OTHER PUBLICATIONS

Brochure for RiteScreen, WindowScreen Options, 2 pages, 2005.

(Continued)

*Primary Examiner* — Blair M Johnson
(74) *Attorney, Agent, or Firm* — Lipsitz & McAllister, LLC

(57) ABSTRACT

A component part assembly for a window or door screen is provided. One or more component parts are provided which add functionality to a window or door screen. An attachment mechanism is provided for attaching the one or more component parts to a screen frame subsequent to manufacture of the screen. The one or more component parts may include at least one of a locking component, a guide component, a slide component, a handle component, a pull tab component, a roller component, a wheel component, a hinge component, a pivot cam component, a weather stripping component, a seal component, a frame component, a barcode component, an RFID component, a flexible attachment component, or the like. The screen frame may be a flexible screen frame or a rigid screen frame, and may be for a full or half window screen or a door screen.

23 Claims, 10 Drawing Sheets

(56) References Cited

U.S. PATENT DOCUMENTS

| | | | | |
|---|---|---|---|---|
| 2,246,663 | A * | 6/1941 | Bradshaw | E06B 9/52 160/354 |
| 2,263,813 | A * | 11/1941 | Mason | E06B 9/52 160/354 |
| 3,042,962 | A * | 7/1962 | Fredricksen | E05D 15/00 16/252 |
| 3,850,464 | A | 11/1974 | Bisbing et al. | |
| 4,044,813 | A * | 8/1977 | Emmons | E06B 3/28 160/354 |
| 4,495,486 | A | 1/1985 | White | |
| 5,552,768 | A | 9/1996 | Mikiel et al. | |
| 5,618,067 | A | 4/1997 | Carlson et al. | |
| 5,666,773 | A * | 9/1997 | Librande et al. | B29C 66/72523 160/369 |
| 5,971,450 | A | 10/1999 | Suarez | |
| 6,557,611 | B1 | 5/2003 | Fuentes | |
| 6,778,086 | B2 | 8/2004 | Morrone et al. | |
| 7,222,458 | B2 | 5/2007 | Polowinczak et al. | |
| D569,998 | S | 5/2008 | Mertinooke et al. | |
| 7,419,555 | B2 | 9/2008 | Kaplo et al. | |
| 7,431,355 | B2 | 10/2008 | Eenigenburg et al. | |
| 7,591,103 | B2 | 9/2009 | Tremble et al. | |
| 7,658,035 | B1 | 2/2010 | Lawrence | |
| 7,740,048 | B2 | 6/2010 | Wilson | |
| 7,841,377 | B2 | 11/2010 | Coenraets | |
| 8,919,826 | B2 | 12/2014 | Small et al. | |
| 8,939,474 | B2 | 1/2015 | Hagemeyer et al. | |
| 2003/0201074 | A1* | 10/2003 | Schnoor | E06B 3/4636 160/90 |
| 2004/0074046 | A1* | 4/2004 | Mimnaugh | E05D 15/063 16/96 R |
| 2006/0028028 | A1 | 2/2006 | Schultz | |
| 2006/0288527 | A1 | 12/2006 | Van Vliet | |
| 2014/0041323 | A1 | 2/2014 | Massey | |
| 2014/0290160 | A1 | 10/2014 | Altieri, Jr. | |
| 2014/0290873 | A1 | 10/2014 | Altieri, Jr. | |
| 2014/0290880 | A1 | 10/2014 | Altieri, Jr. | |
| 2015/0082702 | A1 | 3/2015 | Walter | |
| 2015/0345209 | A1* | 12/2015 | Hornung | E05D 15/0621 49/425 |

OTHER PUBLICATIONS

Catalog for Quanex building products, Window & Door Screens, 33 pages, Jan. 2015.

Product brochure for New York Wire, Screen Products and Accessories, 5 pages, Feb. 2015.

Webpages, Amesbury Truth products, 5 pages, <URL: http://www.amesburytruth.com/products/residential/window/hung/>, retrieved on Jun. 23, 2015.

Webpages, Flexscreen, 4 pages, <URL: http://www.flexscreen.net.html>, retrieved on Jun. 23, 2015.

Product sheet, ALLMETAL, Screen Channel, 1 page, 2008.

Webpages, Screenco, Inc., 7 pages, <URL: http://www.screencoinc.com.html>, retrieved on Jun. 23, 2015.

* cited by examiner

WINDOW SCREENS, SCREEN COMPONENTS, STORM PANELS, AND MARKETING PRODUCTS

This application claims the benefit of U.S. Provisional Application No. 62/005,286 filed on May 30, 2014 which is incorporated herein and made a part hereof by reference for all purposes.

BACKGROUND OF THE INVENTION

The present invention relates to the field of window screens and energy panels or storm windows and to flexible marketing products made using flexible screen manufacturing techniques. More specifically, the present invention relates to attachments for and improvements to rigid and flexible window screens, as well as an extension of the flexible screen concept for use in creating a new kind of energy panel that will increase the performance of a window by adding another layer of protection from the elements. Another aspect of the invention relates to extending the flexible screen concept by the use of differing materials in place of the screening that are printable in order to provide a new way for marketing and advertising.

In typical windows, various mechanisms may be used to retain a traditional window screen in the window. For example, spring loaded clips or pins on or in the screen frame may be used that expand into a channel in the window frame once the screen is placed into the frame. The springs or clips are retracted to install or remove the frame, and expand into the channel once the screen is in place in the window to retain the screen therein. Further, traditional window screens typically have other hardware built into them, including but not limited to weather stripping, rollers, pull tabs, handles, guides, glides, labels, bar codes, and the like.

Flexible window screens are screens having a flexible frame surrounding the screen material. The screen frame is adapted to be flexible so that the entire screen can be compressed to fit inside a window frame and then expand into a channel in the window frame. The flexible screen is retained in the channel by the outward pressure of the flexible screen frame against the channel, such that no retention hardware is needed. Such a flexible screen is shown at the website www.flexscreen.net. Such flexible screens do not typically include any additional components or hardware, which must be separately added if desired.

It would be advantageous to provide components for a flexible screen to enable additional functionality, which are easily attached either at the factory, by a contractor, or by a homeowner. It would also be advantageous to expand on the flexible screen concept to enable similar technology to be applied to other, related areas.

The methods and apparatus of the present invention provide the foregoing and other advantages.

BRIEF DESCRIPTION OF THE DRAWINGS

The present invention will hereinafter be described in conjunction with the appended drawing figures, wherein like reference numerals denote like elements, and:

FIGS. 1A-7A show various component parts for use with a flexible screen, or a rigid screen manufactured without hardware, in accordance with various embodiments of the present invention;

DESCRIPTION OF THE INVENTION

The present invention relates to attachments for and improvements to flexible screens having a flexible screen frame, and the extension of the flexible screen technology into other areas.

Figure 1A:
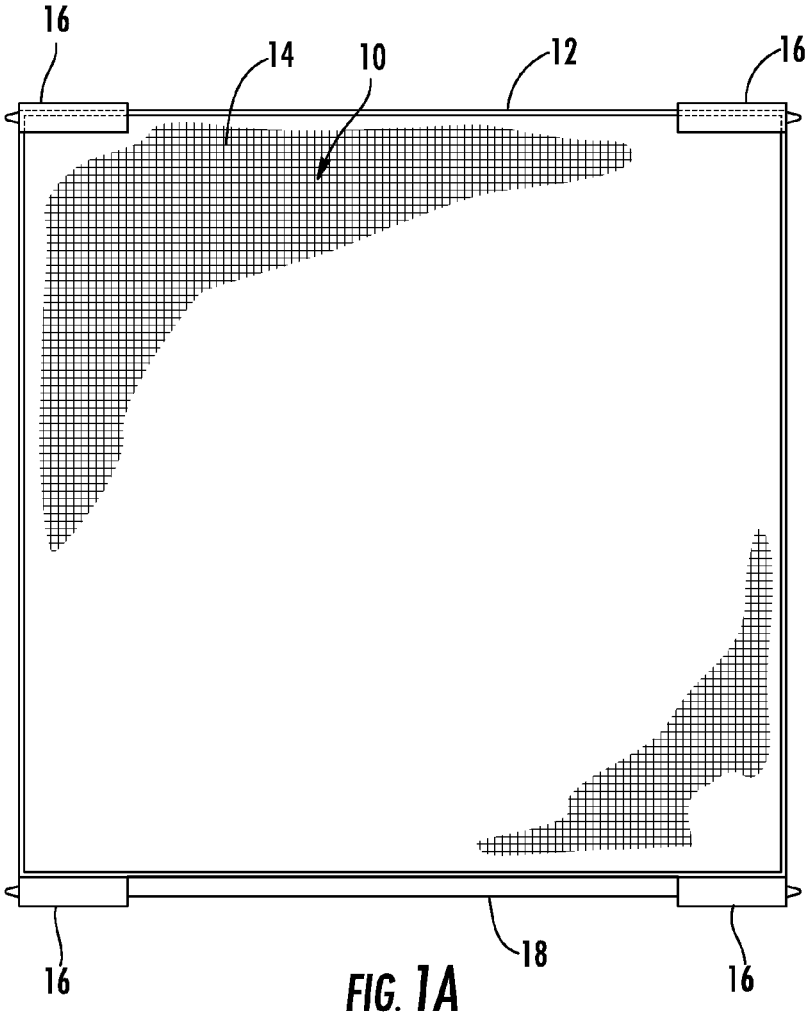
Figure 1B:
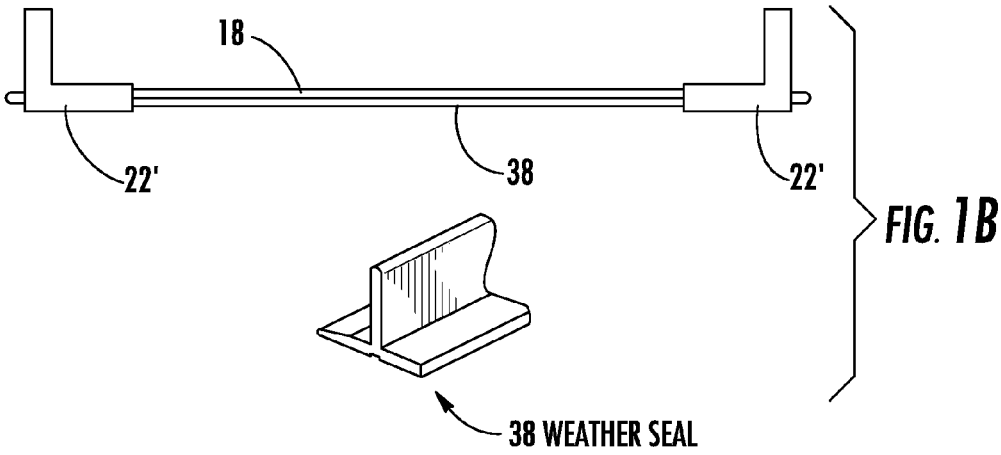

The present invention encompasses various component parts that may snap onto a flexible screen to provide additional functionality. FIGS. 1A-6 show example embodiments of various component parts for a flexible window screen. For example, as shown in FIG. 1A, a locking mechanism 16 may be provided that snaps onto the flexible screen 10 (either onto the frame 12 or onto the frame 12 and a portion of the screen material 14) that enables locking of the screen 10 in the window frame (not shown for clarity). A corresponding lock portion can be provided on the window frame to interact with the locking mechanism 16 on the screen 10. Such interacting portions can be configured in a variety of ways, such as a snap lock connection, a twist lock, a spring loaded locking pin with corresponding pin receiver, a locking mechanism included in a profile of the flexible frame or in a frame component (discussed below), and the like.

Figure 6:
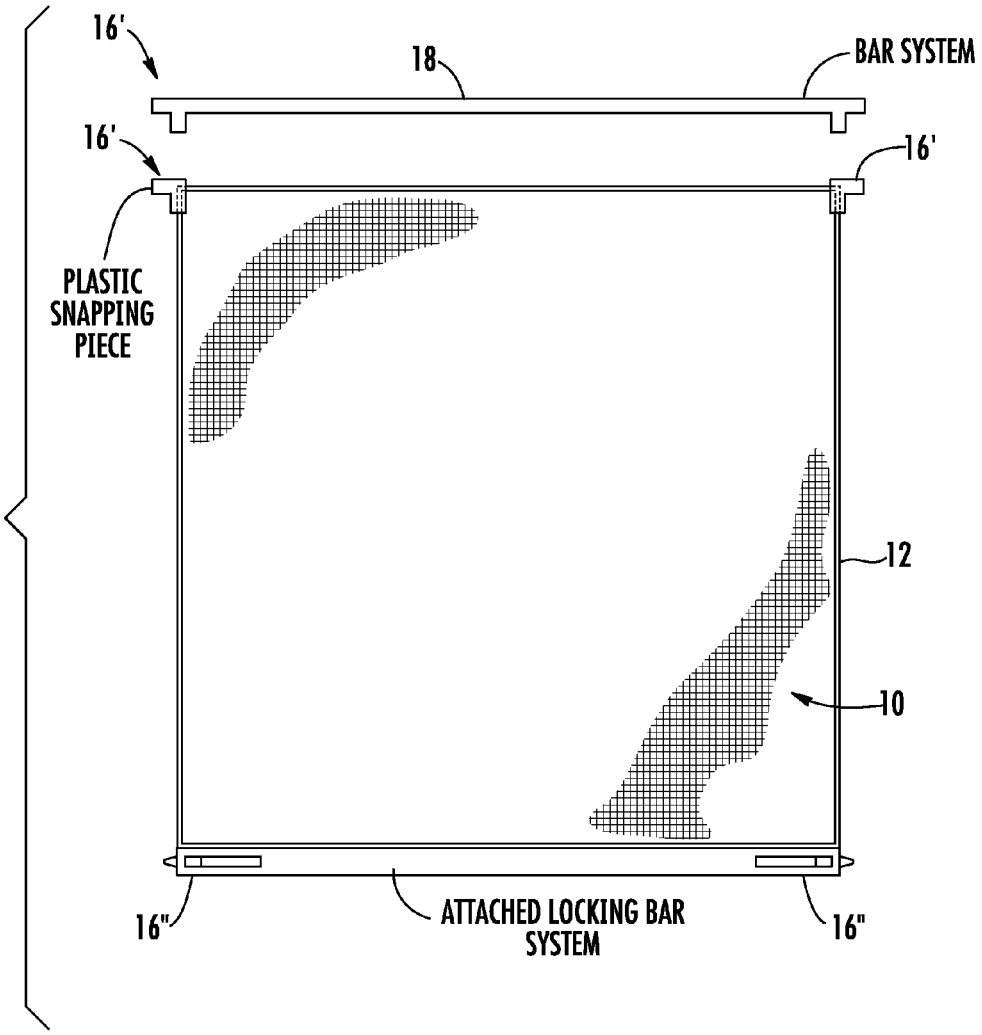
Figure 7A:
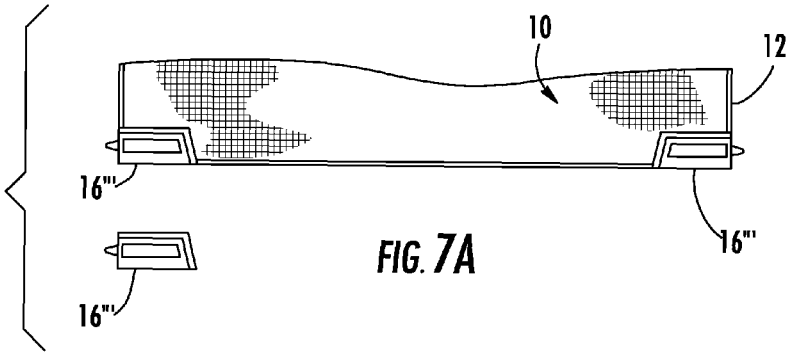

The locking system component could advantageously be used for a double-hung window system. In such an embodiment as shown in FIG. 1A, a locking mechanism 16 can be included in a frame component 18 that is affixed to the flexible screen 10. In addition to the types of locking mechanisms mentioned above, a molded spring locking system that conforms to that of existing double-hung window screens may be integrated into the frame or the frame component. Alternatively, a sliding bolt locking mechanism may be used instead. FIGS. 6 and 7A show various example embodiments of locking mechanisms 16 in accordance with the present invention, including a snap locking mechanism 16', a slide bolt mechanism 16", and a spring loaded locking pin 16'. The various types of locking mechanisms may attach directly to the screen 10 or to a frame component 18 that attaches to the screen frame 12.

Figure 2:
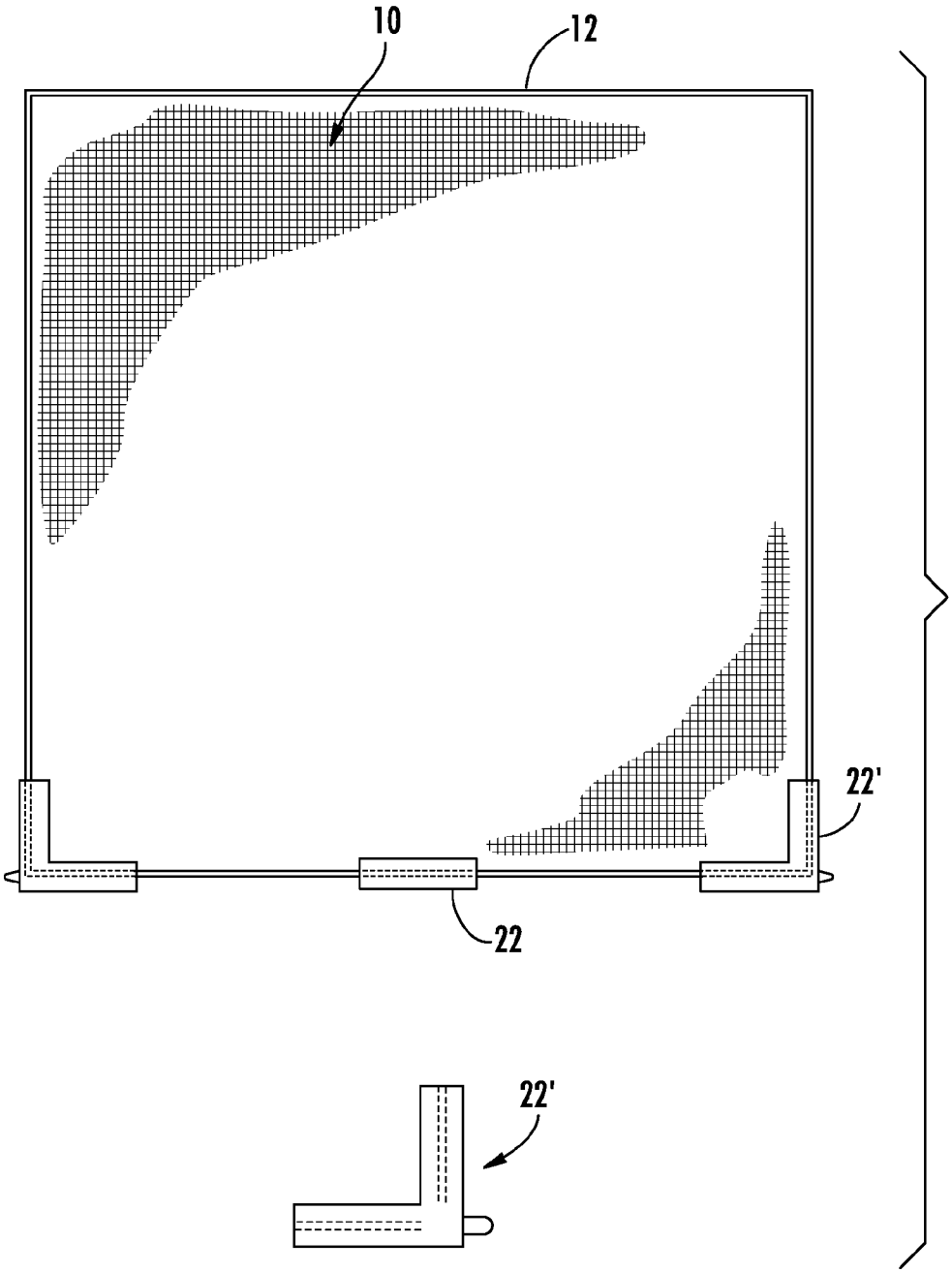
Figure 3:
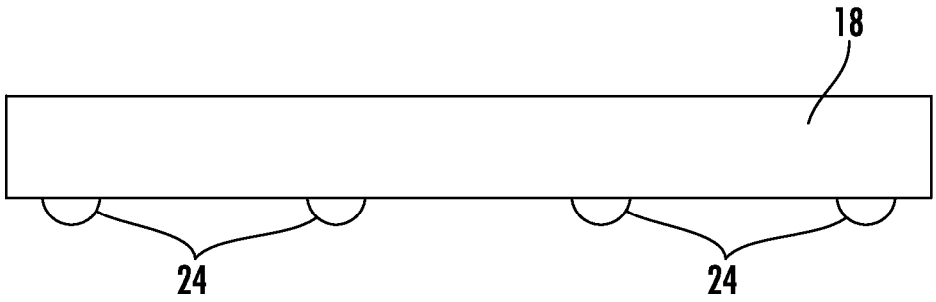
Figure 4:
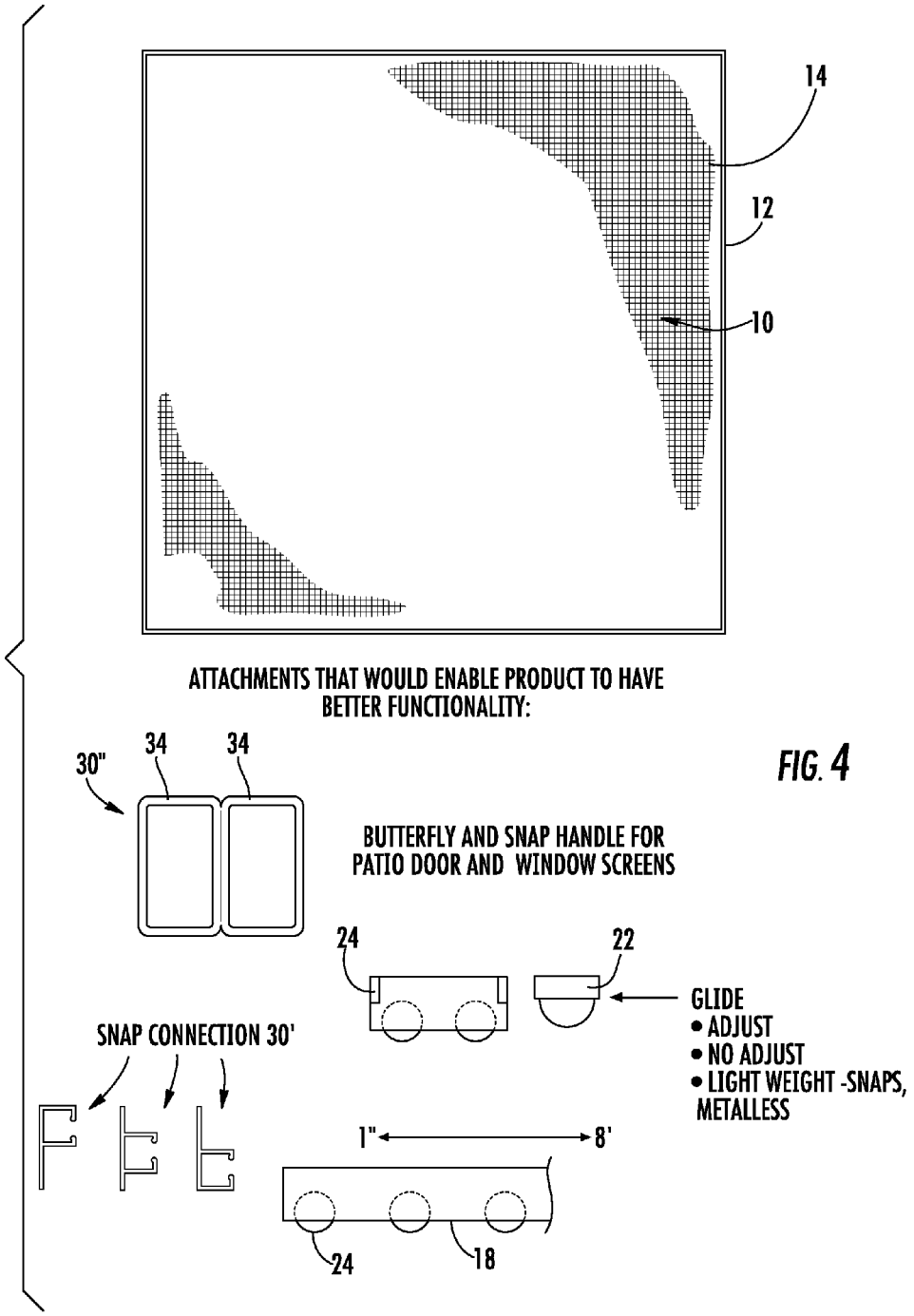

In a similar manner, components that enable a flexible screen to slide, roll, or pivot open in a window or door frame may be provided. As shown in FIGS. 2-7B, such components may include guides or slides 22, combined slides/locking mechanisms 22', rollers or wheels 24, hinges, pivot cams 26, and the like. The locking mechanisms 16 may in some cases also function as pivot systems. As shown in FIG. 4, the wheel component may include one or more wheels and vary in length from one inch to 8 feet, depending on the application. These components may be used to enable flexible screens to replace sliding half-screens used in older windows having sliding storm windows, double-hung screens, or for screens for use in sliding glass doors or pivoting patio doors.

Figure 7B:
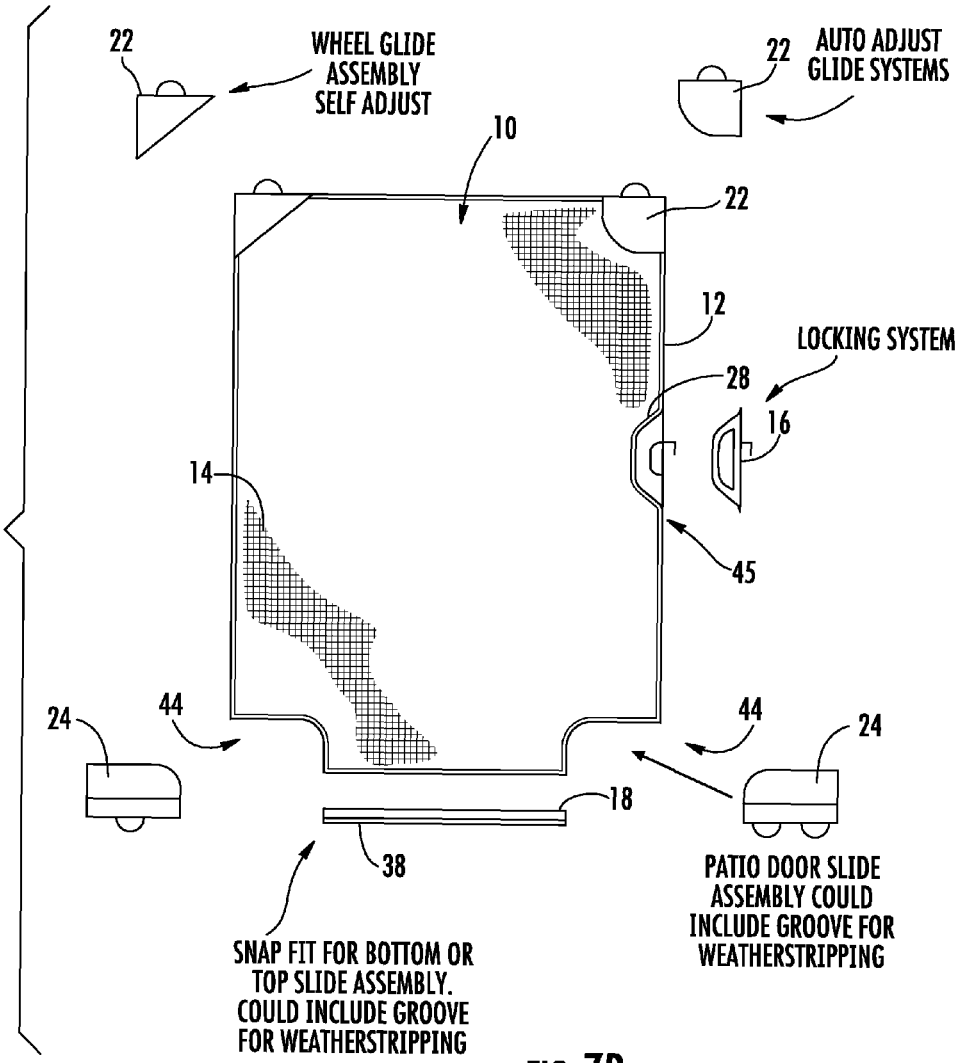
FIG. 7B shows various component parts for use with a sliding screen door or patio door, in accordance with further embodiments of the present invention.

Further, a handle, pull tab or other lifting or handling mechanism 22, 28 could be provided to enable easier handling, lifting, sliding, and installation of the flexible screen. As shown in FIG. 2, a slide 22 may also function as a handle, locking device (22'), or pull tab. As shown in FIG. 7B, a locking mechanism for a screen door may also function as a handle 28. The handle or pull tab could be designed to market the product, include a warning label, and/or have a bar coding system that through an e-commerce strategy enables re-ordering of the product or replacements. The bar code information may contain the screen size and type, manufacturer, distributor, or other information that an application on a smart phone could read, order and/or track.

Figure 5:
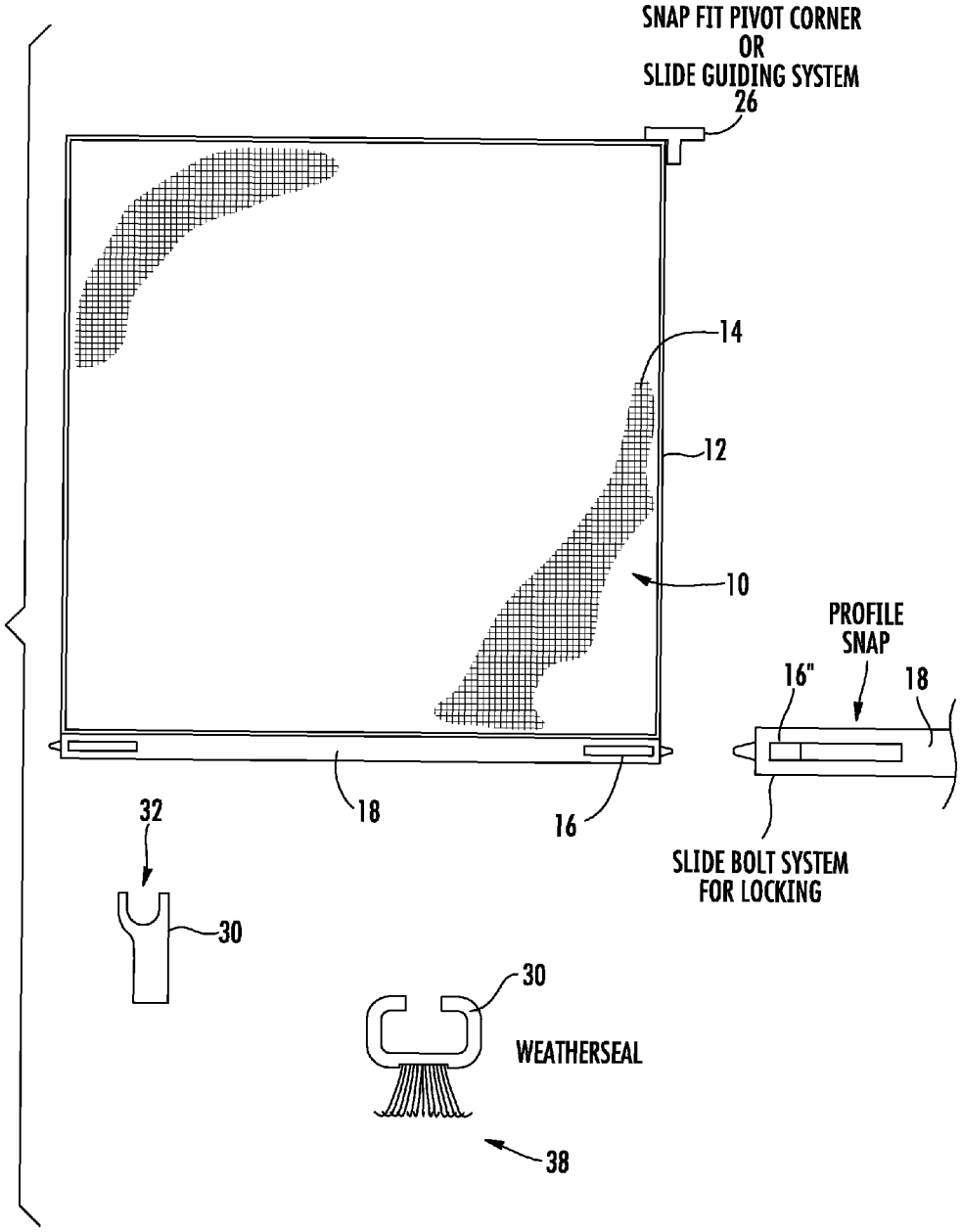

The locking mechanism, sliding component, pivoting component, and handle component may comprise a grooved attachment component 30 (as shown in FIG. 5) that snaps onto the edge of the screen frame 12 and overlap both sides of the screen frame 12. For example, the attachment component may have a groove 32 corresponding to the width of the screen frame 12 such that the frame 12 snaps into the groove 32 of the component. FIG. 4 shows alternate embodiments of an attachment component, including an attachment component 30' adapted for a snap fit over the screen frame 12 as well as a hinged clam-shell or butterfly type component 30". The snap fit attachment component may be located at different locations on the corresponding functional component, depending on the application, as shown in FIG. 4. The hinged clam-shell or butterfly component 30" can be folded over the edge of the screen frame 12 such that the two halves 34 of the clam-shell or butterfly locking mechanism 30" interlock together over the screen frame 12. Other mechanisms for fixing these components to the screen frame may be used, such as rivets, screws, snaps, and the like.

Figure 8:
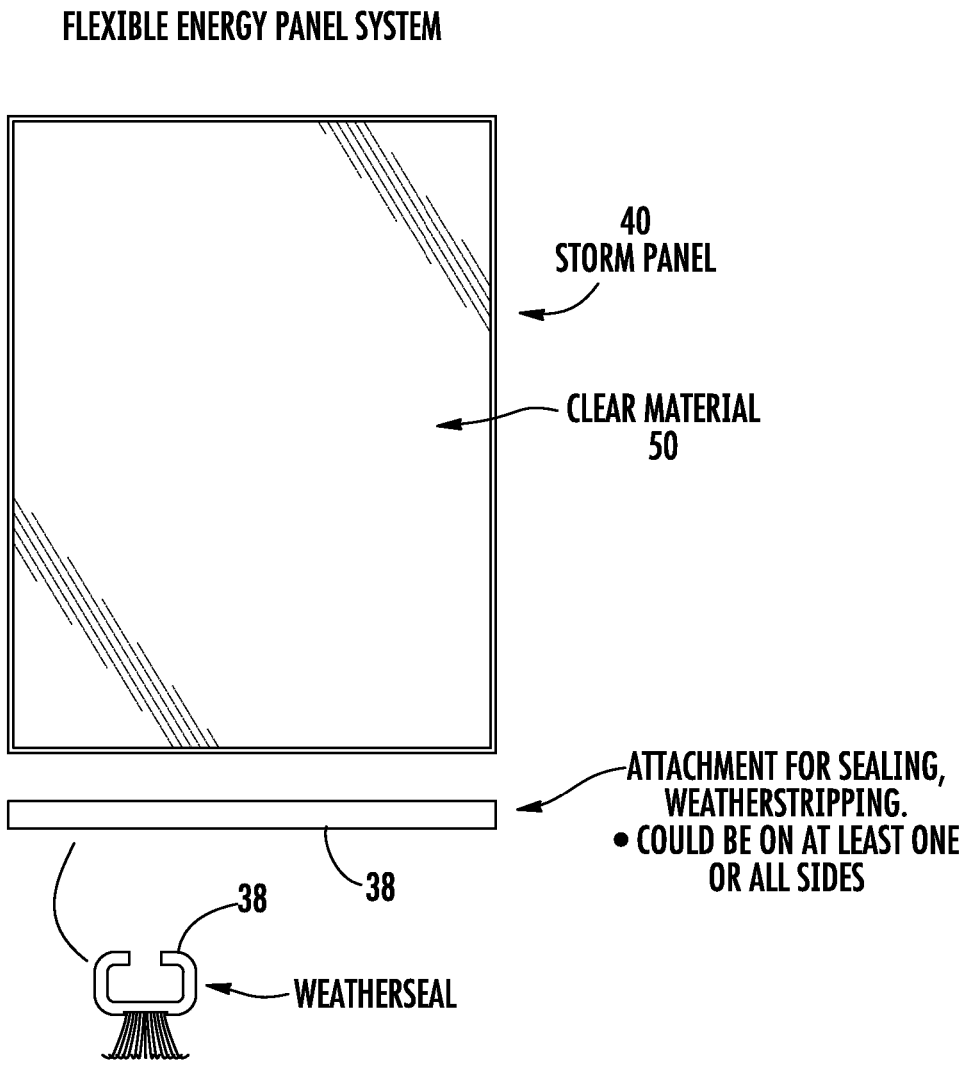
FIG. 8 shows an example of a storm panel made using flexible screen manufacturing technology in accordance with an example embodiment of the present invention.

Weather stripping 38 may be provided on or between any of the various components mentioned above. For example, as shown in FIG. 8, weather stripping 38 may be provided along a length of the screen frame 12 or storm panel 40 (discussed below) between each of the other components to prevent insects or air from entering in gaps between the window channel and screen frame 12 or storm panel 40. The weather stripping 38 may be fixed to the flexible screen 10 in a manner similar to the components mentioned above (e.g., via a grooved attachment component 32 as shown in FIG. 5 or other type of attachment component mentioned herein).

Accordingly, the present invention encompasses a family of products that will enhance performance of a simple flexible screen 10 or storm panel 40 by enabling it to slide, pivot or lock, seal bugs out, and the like, as discussed above.

The component parts described above may also be used to enable flexible screens to be used for sliding screen doors and patio door screens. For example, as shown in FIGS. 3 and 7B, an attachment for a patio door screen in accordance with the present invention may have a molded or extruded housing 18 with wheels 24 that snap fit directly onto the coil system (in the case of a wound patio door screen) or directly onto the screen frame 12. Alternatively, this could be a simple, light-weight snap-on glide 22 as shown in FIG. 4, where the glide 22 is a metal or plastic nub or wheel. The glide 22 could be adjustable or fixed in position. Alternatively, this may be a one piece part or an assembly that would affix directly to the screen frame 12. As shown in FIGS. 7A and 7B, the flexible screen frame 12 may be bent at the corners 44 and/or at the latch area 45 to provide receiving areas for wheels 24 and a latch or locking mechanism 16, 16'''. By forming the screen frame 12 with bends to accommodate the hardware components mentioned herein, the performance and aesthetics of the screen 10 may be enhanced. As a result, the hardware (e.g., wheels 24 and glides 22) can be flush with the screen 10 around the perimeter of the screen 10, thereby preventing the infiltration of bugs and providing a better fit. Although FIG. 7B shows such bends to accommodate the components for use in a screen door, those skilled in the art will appreciate that the same technique can be used to enable flush mounting of the components on the flexible window screens shown in FIGS. 1A-6.

In view of the lightweight nature of the flexible screen 10, the component parts mentioned herein may be made of lighter material than typically used to manufacture such component parts of rigid screens. Further, the component parts, since manufactured separately, need not necessarily be made of the same material as the flexible screen frame 12. Thus costs and materials savings will result.

Alternatively, a stiff screen can be made with the same process typically used for larger sliding screens such as patio doors (except without any integral hardware that is typically added during the manufacturing process). The advantage would be decreased manufacturing costs and the increased structural integrity, with the components discussed herein that would enable the product to function correctly. The same manufacturing process as used for the flexible screen system may be used, however the end product would not necessarily be a flexible product. The frame may be stainless steel, aluminum, fiberglass or plastic. The same process could be used for drop in screens for traditional windows as well. Such a process would provide cost advantages over the traditional methods of manufacturing rigid screens.

Alternatively, a frame system or connecting bar may be provided to act as a connector between one or more of the various components and the screen frame 12. For example, the frame component 18 may serve to hold a locking mechanism 16 and weather stripping 38. The frame component 18 may be easily fixed onto the screen frame 12 (either by a snap-fit, clam-shell attachment mechanism, other means as mentioned above, or by the frame 12 being bent in a way that creates a receiving portion for the component, as shown in FIGS. 7A and 7B).

Further, an attachment may be provided as a complete assembly that enables a flexible screen to function as a patio door or sliding door screen (see, e.g. FIGS. 3 and 7B). The assembly may comprise a frame component 18 that can be easily fixed onto the screen frame 12 as discussed above. The frame component 18 may support a roller or guide system having wheels or glides 24, or a pivot system. The frame component 18 may be fixed to a top of the screen frame 12, a bottom of the screen frame 12, either side or each of the sides. Alternatively, a flexible frame may be dropped into a rigid frame assembly (either a complete or partial rigid frame assembly) to give it structural integrity for use as a patio door or sliding screen door.

A label may also be provided on any of the components mentioned above. The label may identify the manufacturer or distributor, provide warranty information, provide screen name or model identification or specifications, re-order information, and the like.

A barcode component and/or an RFID component (or other computer chip module) may also be provided that includes a barcode system for screen order entry and tracking. Such a barcode, RFID, or computer chip component may be a separate component or integrated into any of the components mentioned herein. Such a barcode, RFID, or computer chip component may enable web based ordering, warranty tracking, and/or GPS functionality. This ordering process could be integrated into a website that could be used to sell and market windows, screens, and/or other products to the consumer. Also, such a component may be part of a consumer, distributor, and/or dealer system or application that automatically tracks screens for manufacture, delivery, and install location, provides alerts relating to warranty and replacement, and/or measures a screen opening in a particular manufacturer's system for use in ordering or re-ordering. Such technology could be used to enable a smart phone to interact with a web system that creates or serves the functionality of a very economical system, it would change the way screens are sold (the distribution channel) whether through a big box, kiosks, smart pads, tablets, glass repair shops or other consumer outlets. Such an application would seamlessly and automatically insure a safe, accurate transition to the new flexible screens, leveraging GPS, accounting, legacy information from the OEM and screen manufacturer. Such an application may also enable a process of tracking information of aging screens in need of replacement to the distribution of new screen products to home and commercial replacement centers.

The component parts contemplated by the present invention may also include the "smart" window blocking device disclosed in Applicant's provisional patent application entitled Portable Internet Enabled Window Blocking Device filed on the same date as the present application. Various features and elements described in the Portable Internet Enabled Window Blocking Device application can be used in conjunction with or integrated into the various elements of the present invention.

Any of the components mentioned above could easily be fitted to the flexible screen 10 at the original equipment manufacturer, at a reseller's facility, or by a contractor or homeowner.

The general concept of the flexible screen 10 could be expanded and used to make storm or energy panels. For example, as shown in FIG. 8, the same type of flexible screen frame could be used in connection with a flexible plastic or thin plexiglass material (e.g., a clear material 50) to create a flexible storm panel 40 that could increase the energy performance of a home. Such panels 40 could also be used as sub-assemblies to create a screen room, entry way, or greenhouse systems, or other building structures. A sub-assembly may be provided that enables the flexible screens or panels to interlock or connect to form part of a screening system for Florida-type screen rooms or patio enclosures.

The hardware components mentioned above would also be available for use with such storm or energy panels 40.

Flexible screen materials may also be used for window shades or outdoor shade structures, such as patio umbrellas, canopies, awnings, and the like.

In addition, the flexible screen concept could be expanded to create signs and promotional products that can be inserted into a window frame in place of a screen. For example, the flexible screen may be painted with an advertisement (e.g., "Sale Today!", "Building for Sale", etc.) or the screen material itself may be made out of multicolored screen fibers woven to create the desired advertisement. Alternatively, the advertisements may be printed on flexible panels which are used in the flexible frames instead of the screen material.

Figure 9:
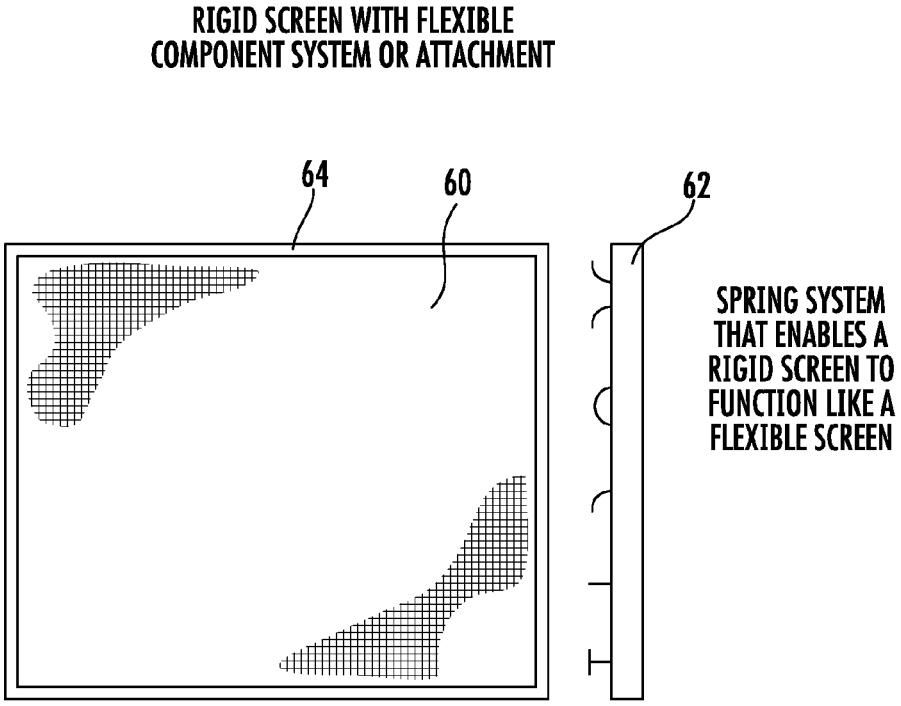
FIGS. 9, 10A and 10B show example embodiments of a flexible device that may be used in connection with rigid screens.
Figure 10A:
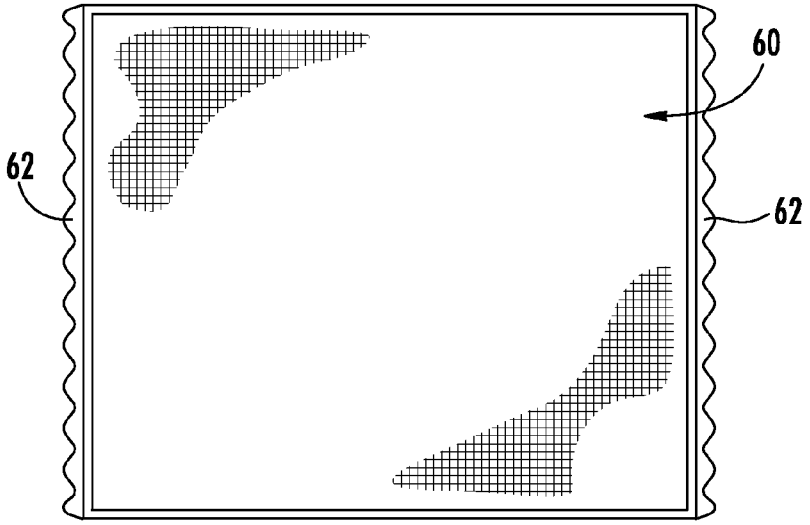

In an alternate embodiment of the present invention, a simple rigid screen 60 with no external hardware may be manufactured (e.g., similar to a traditional window screen without any of its accompanying hardware), which is smaller than a standard window opening at least in a width or a height direction. As shown in FIGS. 9 and 10A, a flexible device 62 (or several of them) may be provided that attach to the rigid screen frame 64 and enables the rigid frame 64 to fit into a window channel in much the same way as the flexible screen does. For example, the flexible device 62 may extend over at least two sides of the rigid screen 60 and fill in the gap between the rigid screen 60 and the window frame in the width or height direction. The flexible device 62 can be compressed such that it can then expand into the window channel, similar to the flexible screen 10 mentioned above. The flexible device 62 can be attached to the rigid screen frame 64 by a snap-fit connection, a clamshell type attachment, or other of the attachment mechanisms mentioned above in connection with the various components for a flexible screen 10.

For patio doors and sliding windows employing such a flexible device, an attachment profile (see. e.g., weather seal 38 as shown in FIG. 8) may be provided that creates a seal (which may be used on the top, bottom, and/or sides) so that the bugs do not enter the home. Such an attachment profile could include wheels and locking mechanisms as discussed above.

Alternatively, a plurality of flexible clips may be used, which are simply shorter sections of a flexible device 62 and operate in the same manner. In such an example embodiment, the rigid screen 60 may be sized to fit the outer dimensions of the window channel, such that the flexible clips are completely within the window channel when the screen is installed, so that no gap is present.

Figure 10B:
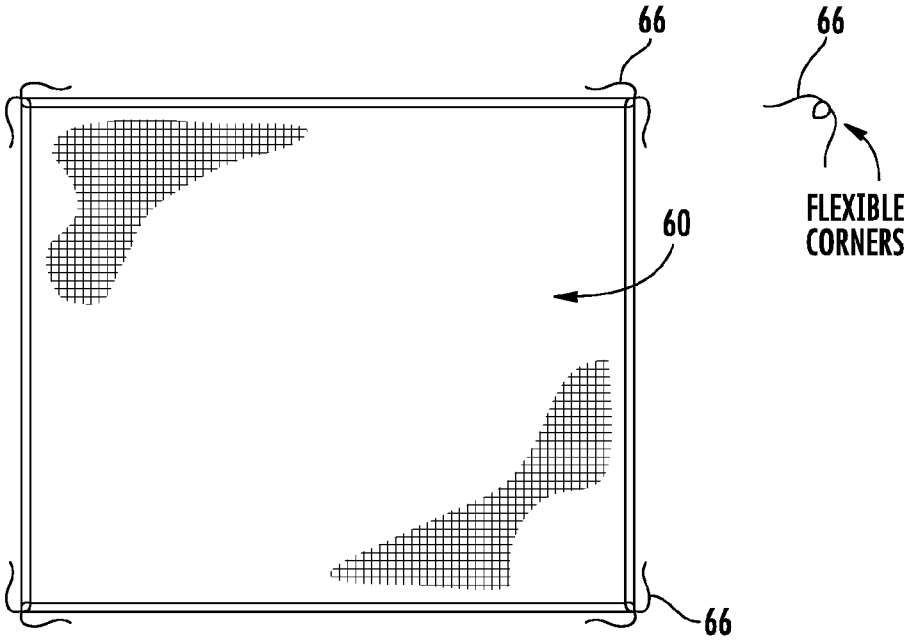

In addition, as shown in FIG. 10B, flexible corner portions 66 may be provided that affix to a rigid 60 or flexible screen 10 and enable it to be inserted into and retained within the window channel.

The flexible screen manufacturing technology may also be extended to window design and manufacturing. Using similar manufacturing techniques for windows as used in producing flexible screen frames would reduce the amount of material (e.g., vinyl) used in window manufacturing. Using such screen frame technology would enable a profile extruder to minimize the current amount of PVC or aluminum to be used. This will result in streamlining of current window design, creating more economical windows with a more efficient frame design.

It should now be appreciated that the present invention provides advantageous component parts and improvements for flexible screens and rigid screens using this process, as well as additional uses for the flexible screen technology.

Although the invention has been described in connection with various illustrated embodiments, numerous modifications and adaptations may be made thereto without departing from the spirit and scope of the invention as set forth in the claims.

What is claimed is:

1. A component part assembly in combination with a window or door screen frame, comprising:

a flexible screen frame for a window or door; and a component part assembly comprising:

two component parts adapted to add functionality to the screen frame;

a frame component connecting the two component parts together, the frame component comprising an elongated bar; and an attachment mechanism disposed on the frame component and adapted for attaching the frame component to the screen frame subsequent to manufacture of the screen frame wherein the attachment mechanism comprises a snap fit connector;

the two component parts comprising two each of or any two of a locking component, a guide component, a slide component, a handle component, a pull tab component, a roller component, a wheel component, a hinge component, a pivot cam component, a weather stripping component, a seal component, a barcode component, an RFID component, and a flexible attachment component.

2. A component part assembly in combination with a window or door screen frame, comprising:

a window or door screen frame, the screen frame comprising one or more concave receiving portions formed by an inward bend of the screen frame in a plane of the screen frame during manufacture;

a component part assembly comprising:

one or more component parts adapted to add functionality to the screen frame; and an attachment mechanism for attaching the one or more component parts to the screen frame subsequent to manufacture of the screen frame;

wherein:

the one or more component parts comprise at least one of a locking component, a guide component, a slide component, a handle component, a pull tab component, a roller component, a wheel component, a hinge component, a pivot cam component, a weather stripping component, a seal component, a frame component, a barcode component, an RFID component, and a flexible attachment component; and the one or more concave receiving portions are adapted to accept the one or more component parts.

3. A component part assembly in accordance with claim 2, wherein the screen frame comprises a flexible screen frame.

4. A component part assembly in accordance with claim 2, wherein the screen frame comprises a window half screen frame.

5. A component part assembly in accordance with claim 2, wherein, once attached to the screen frame in the one or more concave receiving portions, at least a portion of the one or more component parts sits flush or substantially flush with an outer contour of unbent portions of the screen frame.

6. A component part assembly in accordance with claim 2, wherein the one or more concave receiving portions of the screen frame comprise at least one of two or four corners of the screen frame and a handle location of the screen frame.

7. A component part assembly in accordance with claim 2, wherein the attachment mechanism comprises a snap fit connector.

8. A component part assembly in accordance with claim 7, wherein the snap fit connector comprises a grooved component adapted to accept the screen frame.

9. A component part assembly in accordance with claim 2, wherein the attachment mechanism extends over or around a portion of the screen frame and a portion of screen material adjacent the screen frame.

10. A component part assembly in accordance with claim 2, wherein:

the one or more component parts comprises the locking component with one of a snap locking mechanism, a twist locking mechanism, a slide bolt, and a spring loaded locking pin; and the locking component interacts with a channel of a window or door frame or with a corresponding locking component of the window or door frame.

11. A component part assembly in accordance with claim 2, wherein the screen frame comprises a sliding window half screen frame or a sliding door screen frame.

12. A component part assembly in accordance with claim 2, wherein:

at least one of the one or more component parts further comprises a label component.

13. A component part assembly in accordance with claim 12, wherein the label component comprises at least one of product information, product name, product model information, warranty information, product specifications, a warning label, order information, a re-order code, screen size, screen type, distributor information, or manufacturer information.

14. A component part assembly in accordance with claim 2, wherein:

the one or more component parts comprises the barcode component or the RFID component; and the barcode component or the RFID component comprises at least one of product information, product name, product model information, warranty information, warranty tracking information, product specifications, a warning label, order information, a re-order code, screen size, screen type, distributor information, manufacturer information, order tracking information, GPS functionality, and web-based ordering information.

15. A component part assembly in accordance with claim 14, wherein the barcode component or the RFID component provides access to a consumer, manufacturer, or distributor network or website in connection with a software application that enables product ordering, product tracking, product location, warranty tracking, warranty alerts, replacement alerts, and product marketing.

16. A component part assembly in accordance with claim 2, wherein the barcode component or the RFID component are integrated into at least one of the other component parts.

17. A component part assembly in accordance with claim 2, wherein the weather stripping component is disposed on the frame component between two other of the one or more component parts.

18. A component part assembly in accordance with claim 2, wherein the attachment mechanism is integral to the frame component.

19. A component part assembly in accordance with claim 2, wherein:

the screen frame comprises a rigid screen frame sized slightly smaller than a window opening;

the one or more component parts comprise the flexible attachment components;

the flexible attachment components are adapted to be compressed to enable insertion of the rigid screen frame into the window opening, which expand to secure the rigid screen frame in the window frame.

20. A component part assembly in accordance with claim 19, further comprising one or more weather stripping components disposed between the flexible attachment components.

21. A method for improving the functionality and performance of a window or door screen frame, comprising:

providing a window or door screen frame, the screen frame comprising one or more concave receiving portions formed by an inward bend of the screen frame in a plane of the screen frame during manufacture;

providing a component part assembly comprising:

one or more component parts adapted to add functionality to the screen frame;

providing an attachment mechanism for attaching the one or more component parts to the screen frame;

attaching the one or more component parts to the screen frame subsequent to manufacture of the screen frame via the attachment mechanism;

the one or more component parts comprising at least one of a locking component, a guide component, a slide component, a handle component, a pull tab component, a roller component, a wheel component, a hinge component, a pivot cam component, a weather stripping component, a seal component, a frame component, a barcode component, an RFID component, and a flexible attachment component; and the one or more concave receiving portions are adapted to accept the one or more component parts.

22. A component part assembly in combination with a window panel adapted to fit in a window frame, comprising:

a flexible window panel with a flexible window panel frame; and a component part assembly comprising:

one or more component parts adapted to add functionality to the window panel frame;

a frame component on which the one or more component parts are disposed, the frame component comprising an elongated bar; and an attachment mechanism for attaching the frame component to the window panel frame subsequent to manufacture of the window panel frame wherein the attachment mechanism comprises a snap fit connector; and the one or more component parts comprising at least one of a locking component, a guide component, a slide component, a handle component, a pull tab component, a roller component, a wheel component, a hinge component, a pivot cam component, a weather stripping component, a seal component, a barcode component, an RFID component, and a flexible attachment component.

23. A component part assembly as set forth in claim 22, wherein the window panel comprises one of a storm panel, an energy panel, a sign panel, or an advertising panel.

* * * * *